US006125246A

United States Patent [19]

Hashimoto

[11] Patent Number: 6,125,246

[45] Date of Patent: Sep. 26, 2000

[54] CHARGING APPARATUS AND IMAGE FORMING APPARATUS

[75] Inventor: Kouichi Hashimoto, Numazu, Japan

[73] Assignee: Canon Kabushiki Kaisha, Tokyo, Japan

[21] Appl. No.: 08/902,940

[22] Filed: Jul. 30, 1997

[30] Foreign Application Priority Data

Aug. 2, 1996 [JP] Japan ..... 8-220342

[51] Int. Cl.[7] ..... G03G 15/02

[52] U.S. Cl. ..... 399/50; 399/174

[58] Field of Search ..... 399/50, 168, 174, 399/175, 176

[56] References Cited

U.S. PATENT DOCUMENTS

| | | | |
|---|---|---|---|
| 5,351,110 | 9/1994 | Saito et al. | 399/46 |
| 5,426,489 | 6/1995 | Haneda et al. . | |
| 5,600,413 | 2/1997 | Kimura | 399/174 |
| 5,765,076 | 6/1998 | Ogata et al. | 399/168 |
| 5,835,821 | 11/1998 | Suzuki et al. | 399/100 |

FOREIGN PATENT DOCUMENTS

| | | |
|---|---|---|
| 0 689 103 | 12/1995 | European Pat. Off. . |
| 0 709 746 | 5/1996 | European Pat. Off. . |
| 0 735 435 | 10/1996 | European Pat. Off. . |
| 0 766 146 | 4/1997 | European Pat. Off. . |
| 0 789 284 | 8/1997 | European Pat. Off. . |
| 5-66150 | 3/1993 | Japan . |
| 6-230655 | 8/1994 | Japan . |
| 6-250492 | 9/1994 | Japan . |

*Primary Examiner*—Robert Beatty
*Attorney, Agent, or Firm*—Fitzpatrick, Cella, Harper & Scinto

[57] ABSTRACT

A charging device includes a charging member for being supplied with a voltage to electrically charge a rotatable member to be charged, the charging member including a magnetic particle layer contactable to the member to be charged, and a carrying member for carrying the magnetic particle layer; wherein the member to be charged starts to rotate after start of application of the voltage and after the start of rotation of the carrying member.

36 Claims, 6 Drawing Sheets

CHARGING APPARATUS AND IMAGE FORMING APPARATUS

FIELD OF THE INVENTION AND RELATED ART

The present invention relates to a magnetic brush type charging apparatus, that is, a charging apparatus which comprises a charging member (magnetic brush) formed of magnetic particles on a carrier. In order to charge an object, the magnetic brush portion of the charging member is placed in contact with the object to be charged, and charge bias is applied to the charging member.

The present invention also relates to an image forming apparatus in which images are formed using an image formation process inclusive of a process for charging an image bearing member, and the means used in the process for charging an image bearing member is a magnetic brush type charging means.

Prior to the present invention, in an image forming apparatus, for example, a copying machine, a printer, or the like, which employs an electrophotographic system, an electrostatic recording system, or the like, a "corona" type charging device has generally been employed as means for charging an image bearing member such as an electrophotographically sensitive member, an electrostatically recordable dielectric member, or the like.

In order to charge an object with the use of a corona type charging device, a corona type charging device is disposed next to the object, not in contact with the object, and high voltage (for example, a DC voltage of 5 kV–8 kV) is applied to the discharge wire (metallic wire) of the corona type charging device to generate a corona shower. The surface of the object (image bearing member) to be charged is charged to predetermined polarity and potential as it is exposed to this corona shower.

In recent years, a "contact type" charging apparatus (direct type charging apparatus) has come to be put to practical use because of the advantage that it produces a smaller amount of ozone, and also consumes a smaller amount of electricity, compared to a corona type charging apparatus.

In the case of a contact type charging apparatus, the charging member (contact type charging member) is constituted of an electrically conductive member having an adjusted electrical resistance value. When charging an object (image bearing member), this contact type charging member is placed in contact with the object to be charged, and voltage (charge bias) is applied to the charging member to charge the surface of the object (image bearing member) to predetermined polarity and potential.

In particular, a contact type charging apparatus employing an electrically conductive roller as the charging member is desirable in terms of stability in charge.

However, in the case of a system employing the aforementioned electrically conductive charging roller, an object (image bearing member) to be charged is charged by the electrical discharge from a charging roller, as the charging member, to the object to be charged, and therefore, the surface potential of the object (image bearing member) to be charged varies according to the variation of the electrical resistance of the object (image bearing member) to be charged, and the variation of the electrical resistance of the charge roller, which are caused by environmental changes.

As for an answer to the above problem, a contact type charging system (charge injection type charging system) which is less vulnerable to environmental changes is disclosed in Japanese Laid-Open Patent Application No. 5748/1995, and the like. According to this system, voltage is applied to an electrically conductive contact type charging member to inject electrical charge into traps which are present in the surface layer of a photosensitive member as an object to be charged.

This charge injection type charging system is advantageous in that not only is it less sensitive to environmental changes, but also it does not use electrical discharge to charge an object, and therefore, it does not generate ozone which reduces the service life of an image bearing member.

Further, referring to FIG. 5, in order to charge an object to a predetermined potential level $V_S$ using a contact type charging system based on electric discharge, it is necessary to apply, to a charging member, a DC bias ($V_S+V_{th}$), that is, a voltage composed of a voltage of a desirable level $V_S$ and a discharge threshold voltage $V_{th}$ (voltage at which an object to be charged begins to be charged when DC voltage applied to a contact type charging member is gradually increased) superimposed thereon. However, in order to charge an object to the predetermined level $V_S$ using a charging system based on charge injection, only a DC voltage having substantially the same level as the predetermined voltage $V_S$ has to be applied to the charging member, and therefore, it is possible to reduce the cost for the power source for charging.

As for the contact type charging member based on charge injection, a magnetic brush type charging member or a fur brush type charging member are desirable from the standpoint of reliability in terms of charge, contact, and the like.

A magnetic brush type charging member has a magnetic brush, or electrically conductive magnetic particles magnetically held, like bristles of a brush, on a carrier which doubles as a power supply terminal In order to charge an object, the magnetic brush portion of a magnetic brush type charging member is placed in contact with the object, and electrical power is supplied to the carrier. More specifically, electrically conductive magnetic particles are carried directly on a magnet or on the peripheral surface of a sleeve which contains a magnet, being thereby magnetically held like bristles or a brush, wherein an object to be charged is charged by applying voltage to the magnetic brush type charging member which is fixedly disposed or rotated, with the magnetic brush portion of the magnetic brush type charging member being placed in contact with an object to be charged.

A fur brush type charging member has a brush portion (fur brush portion) formed of electrically conductive bristles planted on a carrier which doubles as a power supply terminal. In order to charge an object, the electrically conductive bristle portion is placed in contact with the object, and power is supplied to the carrier.

In comparison, a fur brush type charging member deteriorates more than a magnetic brush type charging member in terms of charging performance. For example, when continuously used, or left unused, for a long time, the bristles of the fur brush portion are liable to be semipermanently bent, causing the charging performance to deteriorate, whereas a magnetic brush type charging member does not suffer from such a phenomenon, being able to reliably maintain the charging performance.

However, a magnetic brush type charging member suffers from a different problem; the magnetic particles which form a magnetic brush are adhered to the surface of an object to be charged, or become separated from the main body of the magnetic brush.

More specifically, in the case of a charge injection system which employs a magnetic brush type charging member, when the contact resistance between the magnetic brush and an object to be charged is larger than the electrical resistance of the magnetic brush or the object, if the voltage being applied to the magnetic brush type charging member suddenly changes, a large amount of potential difference is created across the contact interface between the magnetic brush and the object. As a result, the electrostatic force generated by the potential difference across the interface becomes larger than the magnetic force which works to confine the magnetic particles in the form of a brush on the carrier. Consequently, a certain amount of magnetic particles are adhered to the surface of the object to be charged.

An object to be charged must be sufficiently charged while the peripheral surface of the object is run through a charging nip, that is the contact between the object and the magnetic brush. Therefore, the electrical resistance of the magnetic brush is rendered low. Thus, the contact resistance between the magnetic brush and the object to be charged is likely to become larger than the electrical resistance of the magnetic brush type charging member, causing magnetic particles to adhere to the surface of the object to be charged.

The following should be noted here. In the case of the magnetic brush formed of the magnetic particles used for development (magnetic carrier for development), toner particles and additive particles are interposed among the magnetic particles, increasing the overall electrical resistance of the magnetic brush for development. Therefore, the difference in potential across the contact between the magnetic brush for development and an image bearing member as an object to be charged is relatively small. As a result, it is not liable to occur that the magnetic particles for development adhere to the surface of the image bearing member.

The instants when the change in the potential of a magnetic brush type charging member becomes largest are the instants when the charge bias power to the magnetic brush type charging member is turned on, and when it is turned off. FIGS. 7, (*a*) and (*b*) show the changes which occur to the potential of any given spot on the surface of an object (image bearing member) to be charged while this spot passes through a charging nip N. The abscissa represents the elapsed time from when any given spot on the surface of the object to be charged enters the charging nip N, and the axis of ordinate represents the potential of the spot correspondent to the elapsed time. The width of the charging nip N is 8 mm, and the speed at which any given spot on the surface of the object to be charged is passed through the charging nip N is 150 mm/sec. In other words, the time necessary for any given spot on the surface of the object to be charged to pass through the charging nip N is approximately 53 msec.

FIG. 7, (*a*) represents a case in which charge bias is continuously applied to a magnetic brush type charging member. In this case, after any given spot on the surface of an object to be charged enters the charging nip N, the potential of the spot increases with time, and by the time the spot comes out of the charging nip N, its potential reaches the same voltage level as that of the charge bias being applied to the magnetic brush type charging member.

FIG. 7, (*b*) represents a case in which the application of charge bias to a magnetic brush type charging member is started the instant when any given spot on the surface of an object to be charged enters the charging nip N. Generally speaking, it takes approximately 50 msec for DC charge bias to start up, and therefore, some spots on the surface of an object to be charged come out of the charging nip N before their potential reaches a satisfactory voltage level; in other words, the voltage level of the surface potential of the object to be charged becomes different from that of the charge bias. As a result, some of the magnetic particles which form the magnetic brush portion of the magnetic brush type charging member are adhered to the object to be charged.

FIG. 7, (*c*) represents the surface potential level of any given spot on the surface area of an object to be charged which is in the charging nip N at the instant when the application of charge bias to a magnetic brush type charging member begins, at the instant when the spot comes out of the charging nip N. The abscissa shows the charging nip portion at the instant when the application of charge bias begins. As shown in the drawing, at the instant when any given spot on the surface of an object to be charged which is in the charging nip N, immediately adjacent to the exit side, when the application of charge bias begins, comes out of the charging nip N, the surface potential level of the spot is not too much different from the level of the charge bias, and therefore, the adhesion of the magnetic particles to the object to be charged does not occur. On the other hand, at the instant when any given spot on the surface of an object to be charged, which is in the charging nip N, adjacent to the entrance side, comes out of the charging nip, the surface potential of the spot is substantially different from the level of the charge bias, and therefore, the magnetic particle adhesion occurs.

The preceding description pertains to the phenomenon which occurs at the start of a charging process. However, the magnetic particles, which form the magnetic brush portion of a magnetic brush type charging member adheres to the surface of an object to be charged, due to the similar mechanism, at the end of the charging process.

The magnetic particles which become separated and adhere to the surface of an object to be charged, as described above, are carried away as the surface of the object moves, and therefore, the magnetic particles which form the magnetic brush portion are gradually lost. Consequently, the magnetic brush portion becomes too thin to maintain satisfactory contact with the object to be charged, allowing the occurrence of charge failure.

Further, the magnetic particles which become separated from the magnetic brush portion are sometimes picked up by the developing apparatus of an image forming apparatus, and obviously adversely affect image development since the volumetric resistivity of the magnetic particles for a charging apparatus is smaller than the volumetric resistivity of the magnetic particles for a developing apparatus.

Referring to FIG. 6, in order to improve the rising speed the potential level of the surface of an object to be charged, charge uniformity, and charge stability, a magnetic brush type charging member (magnetic particle carrier) may be rotated in the same direction as an object to be charged (in a charging nip, the magnetic brush portion moves in the direction opposite to the surface of an object to be charged), and/or an AC component (alternating voltage component) may be superimposed on a DC component as the voltage (charge bias) applied to a magnetic brush type charging member. When such measures are taken, the magnetic particles in the magnetic brush portion 2*c* of a magnetic brush type charging member 2 are liable to collect on the downstream side of the charging nip N, relative to the direction a in which an object 1 to be charged is moved (rotated). This is due to the fact that as the voltage level of the applied AC component makes a peak-to-peak change (when voltage level fluctuation becomes maximum) certain amount of magnetic particles are adhered to the surface of the object 1, being moved in the direction opposite to the direction in which the magnetic particle carrier 2*c* is moved, and therefore, the magnetic particles are prevented from moving smoothly within the magnetic brush portion. The magnetic particles collecting as shown in FIG. 6 are disposed farther from the magnetic pole of the magnetic particle carrier 2*b*, being less affected by the confining force of the magnetic field, than the rest of the magnetic particles, and therefore, they are liable to be pulled away from the magnetic brush portion by electrostatic force and/or mechanical adhesive force.

Sequences for turning on or off charging bias to prevent magnetic particles from adhering to the object 1 to be charged is disclosed in the Official Gazette Tokkai Nos. 230655/1994, 250492/1994, and the like. According to these sequences, when DC bias is quickly turned on or off to shorten an On/Off process, a large amount of the magnetic particles from the magnetic brush portion adhere to the surface of the object 1 in the charging nip portion, and become separated from the magnetic brush type charging member as they are moved out of the charging nip portion by the movement of the object 1.

SUMMARY OF THE INVENTION

The primary object of the present invention is to provide a charging apparatus and an image forming apparatus, in which the magnetic particles of the charging apparatus do not adhere to an object to be charged.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

DESCRIPTION OF THE PREFERRED EMBODIMENTS (1) An Example of an Image Forming Apparatus FIG. 1 is a schematic side elevation of an image forming apparatus in accordance with the present invention. The image forming apparatus in this embodiment is a laser beam printer which employs a transfer type electrophotographic process.

Figure 1:
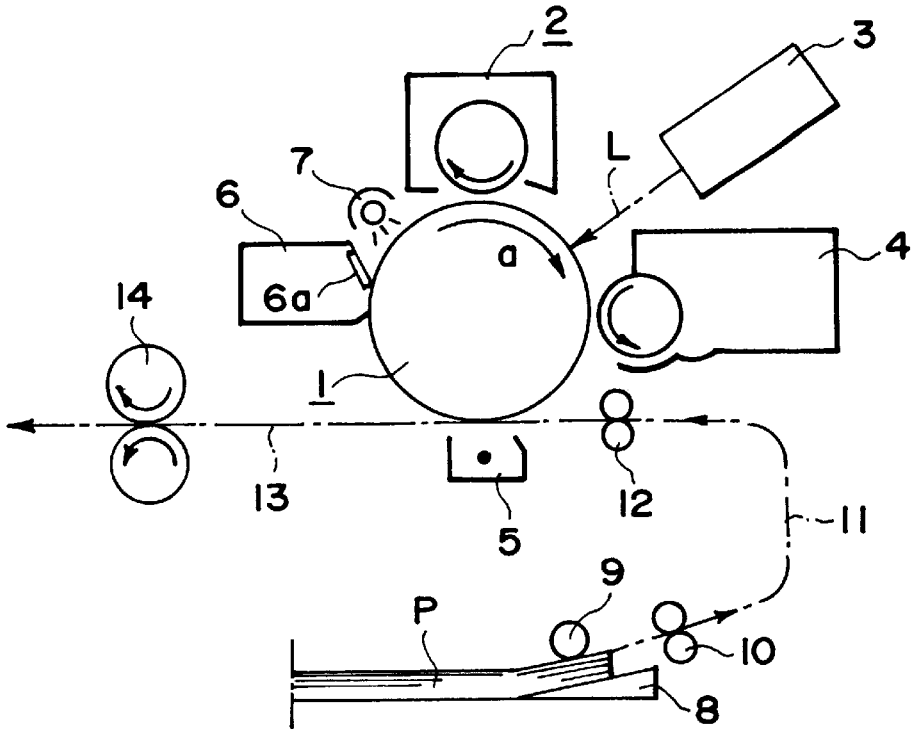
FIG. 1 is a schematic elevation of an image forming apparatus in accordance with the present invention.

A reference numeral 1 designates an electrophotographically sensitive member as an image bearing member (object to be charged) in the form of a drum (hereinafter, "drum"). In this embodiment, it is rotatively driven in the clockwise direction indicated by an arrow mark a at a process speed (peripheral velocity) of 150 mm/sec.

Figure 2:
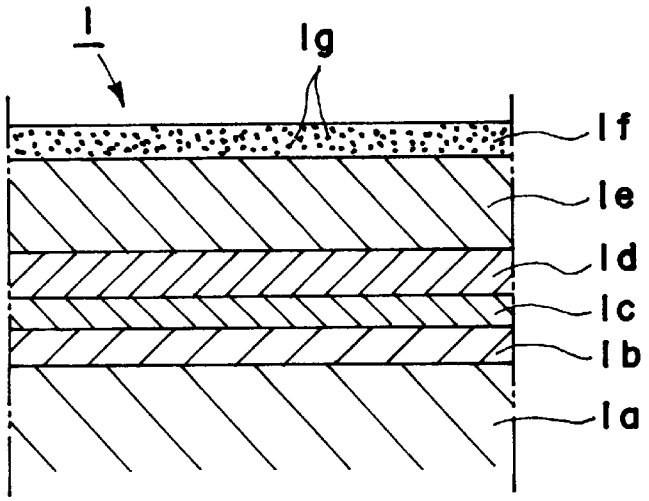
FIG. 2 is a schematic section of the surface portion of a photosensitive member in accordance with the present invention, depicting the laminar structure thereof.

The drum 1 is an organic photoconductive member which is negatively chargeable by charge injection. Referring to FIG. 2 which shows the laminar structure of the surface portion of the drum 1, the drum 1 comprises an aluminum drum 1*a*, that is, a base member, having a diameter of 30 mm, and first to fifth functional layers 1*b*–1*f* laminated on the base member in this order from the bottom. The function of each layer will be described in Section (2).

A reference numeral 2 designates a means for charging the drum 1. In this embodiment, it is a magnetic brush type charging apparatus. The peripheral surface of the rotary drum 1 is substantially uniformly charged to a potential level of −700 V with the use of the magnetic brush type charging apparatus 2, which injects charge into an object by being placed in contact with the object. This magnetic brush type charging member 2 will be described in more detail in Section (3).

A reference numeral 3 designates an image information exposing means. In this embodiment, it is a laser beam scanner. This laser beam scanner 3 comprises a semiconductor laser, a polygon mirror, an F-θ lens, and the like. To the laser beam scanner, sequential electrical digital signals reflecting the information of a target image are inputted from an unillustrated host apparatus, for example, an original reading apparatus, a computer, or a word processor. The laser beam scanner 3 projects a scanning laser beam L modulated with the sequential electric digital signal onto the surface of the uniformly charged surface of the rotary drum 1, exposing thereby the surface. As a result, an electrostatic image correspondent to the information of the target image is formed on the peripheral surface of the rotary drum 1.

A reference numeral 4 designates a means for developing the electrostatic latent image. In this embodiment, it is a developing apparatus employing a single component, non-contact jumping development system, and uses magnetic toner as developer. It reversely develops the electrostatic latent image formed on the peripheral surface of the rotary drum 1 into a toner image.

A reference numeral 8 designates a sheet feeder cassette. It stores recording material P (transfer material) in stacks. As a sheet feeder roller 9 is driven, the recording materials P stored in stacks in the sheet feeder cassette 8 are fed out of the cassette 8 one by one, being separated as they are fed out, and then are conveyed to a registration roller pair 12 through a sheet path 11 inclusive of a conveyer roller pair 10. The registration roller 12 controls the recording material P so that the recording material P is fed, with a predetermined timing, into a transfer station, that is, the nip between the rotary drum 1 and a transfer charger 5 (corona type charger).

The transfer charger 5 charges the back (bottom) side of the recording material P to the polarity opposite to the polarity of toner as the recording material P is fed into the transfer station. As a result, the toner image on the peripheral surface of the rotary drum 1 is electrostatically transferred onto the front (top) surface of the recording material P, continuously from the leading end to the trailing end, as the recording material P is fed into the transfer station.

After receiving the toner image while passing through the transfer station, the recording material P is separated from the rotary drum 1 starting from the leading end, and is introduced into a fixing apparatus 14 (for example, a heat roller type fixing apparatus), in which the toner image is fixed to the recording material P. Thereafter, the recording material P is discharged as a finished print from the image forming apparatus.

After the separation of the recording material P, the peripheral surface of the rotary drum 1 is cleaned by the cleaning blade of a cleaner 6 to remove the toner which fails to be transferred and remains on the peripheral surface of the rotary drum 1. Then, the peripheral surface of the rotary drum 1 is exposed by a pre-exposure lamp 7, being thereby removed of the remaining charge (electrical memory is removed), to be used for the following image formation.

(2) Drum 1

As described above, the drum 1 in this embodiment is an organic photoconductive member, which is chargeable to negative polarity by charge injection, and comprises a grounded aluminum drum 1*a*, that is, the base member 1*a*, having a diameter of 30 mm, and first to fifth functional layers laminated on the peripheral surface of the base member 1*a* in this order from the bottom, as shown in FIG. 2, a schematic drawing of the laminar structure of the surface portion of the drum 1.

First layer 1*b*: approximately 20 μm thick electrically conductive undercoat layer provided to cover or smooth the defects or the like of the aluminum drum base 1*a*, and also to prevent the occurrence of the moire caused by the reflection of the exposure laser beam.

Second layer 1*c*: approximately 1 μm thick medium resistance (adjusted to approximately $10^6$ ohm.cm) layer composed of Amiran resin and methoxymethylate nylon, which plays a role in preventing the negative charge from being canceled by the positive charge injected from the aluminum drum base 1*a*.

Third layer 1*d*: approximately 0.3 μm thick charge generation layer which is composed of resin material, in which diazoic pigment is dispersed, and generates a positive-negative charge pair as it is exposed to a laser beam.

Fourth layer 1*e*: charge transfer layer composed of polycarbonate and hydrazone dispersed in the polycarbonate; it is p-type semiconductor, and therefore, the negative charge given to the peripheral surface of a photosensitive member cannot pass through this layer, and only the positive charge generated in the charge generation layer 1*d* is transferred to the peripheral surface of the photosensitive member.

Fifth layer 1*f*: approximately 3 μm thick coated charge injection layer composed of photocurable acrylic resin, as binder, and a gram of light transmissive electrically conductive microscopic tin particles dispersed in the binder resin by 70 wt. %. The electrical resistance value of this charge injection layer if need to be within a range of $1\times10^{10}$–$1\times10^{14}$ ohm.cm in order to ensure sufficient charge and also to prevent "image flow". In this embodiment, the surface resistance is $1\times10^{11}$ ohm.cm. As for the volumetric resistivity of the charge injection layer If, it is obtained by measuring the volumetric resistivity of a charge injection layer sample in the form of a sheet, using a High Resistance Meter 4329A (Yokogawa-Hewlette-Packard) connected to Resistivity Cell 16008A, while applying 100 V.

(3) Magnetic Brush Type Charging Apparatus 2

Figure 3:
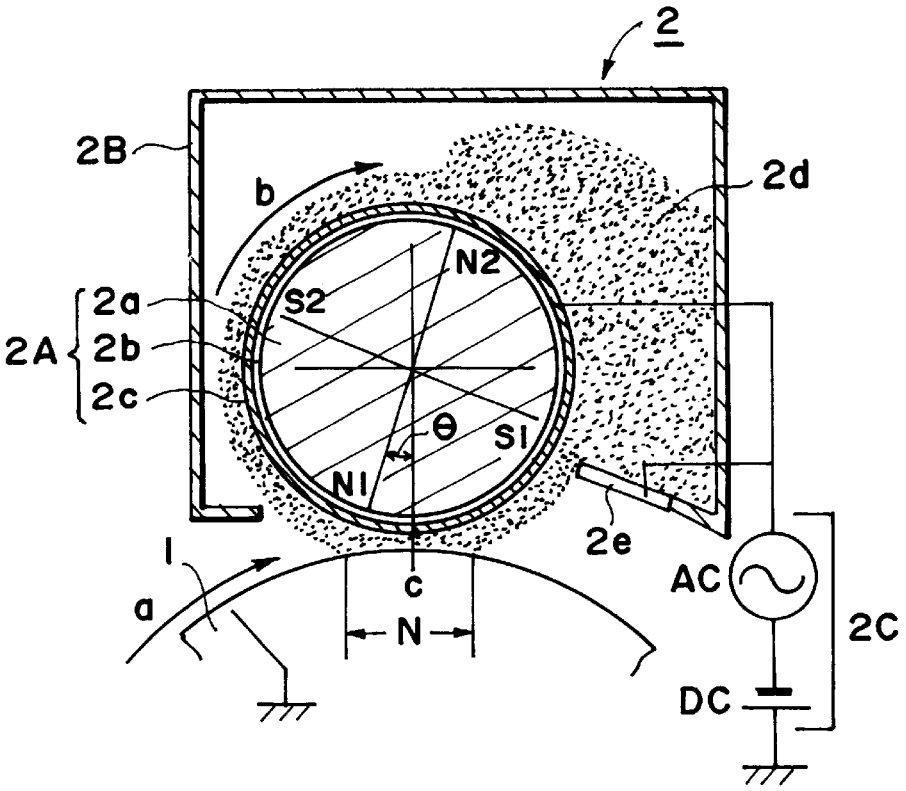
FIG. 3 is an enlarged schematic side elevation of a magnetic brush type charging apparatus.

FIG. 3 is an enlarged side elevation of the magnetic brush type charging apparatus 2. The magnetic brush type charging apparatus in this embodiment roughly comprises a magnetic brush type charging member 2A, a housing 2B for the magnetic brush type charging member 2A and electrically conductive magnetic particles 2*d* (carrier), a power source 2C for applying charge bias to the magnetic brush type charging member 2A, and the like.

The magnetic brush type charging member 2A in this embodiment is of a rotary sleeve type, and comprises a magnetic roller 2*a*, a nonmagnetic stainless steel sleeve 2*b* (which may be called a sleeve type terminal, electrically conductive sleeve, charger sleeve, or the like), and a magnetic brush 2*c*. The sleeve 2*b* is fitted around the magnetic roller 2*a*, and a magnetic brush 2*c* is constituted of the magnetic particles 2*d* held, like bristles of a brush, on the peripheral surface of the sleeve 2*b* by the magnetic force from the magnetic roller 2*a* within the sleeve 2*b*.

The magnetic roller 2*a* is a nonrotative roller, and is firmly fixed. The sleeve 2*b* is coaxially rotated around the magnetic roller 2*a* by an unillustrated driving system in the clockwise direction indicated by an arrow mark b at a predetermined peripheral velocity, which is 225 mm/sec in this embodiment. The distance between the peripheral surfaces of the sleeve 2*b* and the drum 1 is maintained at approximately 500 μm with the use of spacer rings or the like.

A reference FIG. 2*e* designates a regulator blade which is formed of nonmagnetic stainless steel and regulates the thickness of the magnetic brush layer. The blade 2*e* is disposed so that its tip holds a gap of 900 μm from the peripheral surface of the sleeve 2*b*.

A certain amount of the magnetic particles 2*d* held in the housing 2B are held as the magnetic brush 2*c* on the peripheral surface of the sleeve 2*b* by the magnetic force from the magnetic roller 2*a* within the sleeve 2*b*. As the sleeve 2*b* is rotated, the magnetic brush 2*c* is rotated together with the sleeve 2*b* in the same direction. The thickness of the magnetic brush layer 2*c* is regulated by the blade 2*e* so that it remains uniform. Since the regulated thickness of the magnetic brush layer is larger than the gap between the peripheral surfaces of the sleeve 2*b* and the drum 1, the magnetic brush 2*c* forms a contact nip with a predetermined width, between the sleeve 2*b* and drum 1. This contact nip constitutes the charging nip N. Therefore, the rotary drum 1 is rubbed in the charging nip N by the magnetic brush 2*c* which follows the rotation of the sleeve 2*b* of the magnetic brush type charging member 2A. In the charging nip N, the direction in which the drum 1 moves and the direction in which the magnetic brush 2*c* moves are opposite to each other; therefore, their peripheral velocities relative to each other are increased.

To the sleeve 2*b* and the magnetic brush layer regulating blade 2*e*, a predetermined charge bias is applied from a power source 2C.

In other words, the drum 1 is rotatively driven; the sleeve 2*b* of the magnetic brush type charging member 2A is rotatively driven; and the predetermined charge bias is applied from the power source 2C, whereby the peripheral surface of the rotary drum 1 is uniformly charged to predetermined polarity and potential level through a contact type charging process, which, in this embodiment, is a charge injection type charging process.

The magnetic roller 2*a* is fixedly disposed within the sleeve 2*b* so that its magnetic pole N1 (main pole) having a magnetic force of approximately 9000 G is displaced 10 deg. in the upstream direction, relative to the direction in which the drum rotates, from the point c at which the distance between the sleeve 2*b* and the drum 1 is smallest.

It is desirable that the angle (θ in the drawing) of displacement of this main pole N1 in the upstream direction, relative to the direction in which the drum 1 is rotated, from the point c, at which the distance between the sleeve 2*b* and the drum 1 is smallest, is in the range of 10 to 20 deg., preferably in a range of 0 to 15 deg. If the main pole N1 is displaced in the downstream direction by no less than 10 deg., the magnetic particles are liable to collect on the downstream side of the charging nip N since the magnetic particles are attracted to the position correspondent to the main pole N1. If the main pole N1 is displaced in the upstream direction by no less than 20 deg., the magnetic particles cannot be efficiently conveyed after they come out of the charging nip N, and as a result, they are liable to collect.

Further, if the magnetic pole is not within the charging nip N, the magnetic force which holds the magnetic particles on peripheral surface of the sleeve 2*b* will be weak, and therefore, the magnetic particles are liable to adhere to the drum 1.

In this embodiment, the charging nip N means the region in which the magnetic particles carried on the sleeve 2*b* are in contact with the drum 1 while the drum 1 is charged.

The charge bias is applied to the sleeve 2*b* an the regulator blade 2*e* from the power source 2C. The charge bias in this embodiment is such a bias that is composed of a DC component and an AC component superimposed on the DC component. It should be noted here that the charge bias may be composed of a DC component alone; the presence of an AC component is not requisite.

The value of the DC component level in this embodiment is −700 V which is the same as that of the surface potential level of the drum.

The AC component is desired to be no less than 100 V and no more than 2000 V in peak-to-peak voltage Vpp, preferably no less than 300 V and no more than 1200 V. If the Vpp is below the aforementioned range, the effect of the AC component is weak in terms of improvement in charge uniformity and the speed at which potential level of an object to be charged rises. If the Vpp is above the aforementioned range, the aggregation of magnetic particles and the adhesion of magnetic toner to the drum surface are worse. The frequency of the AC component is desired to be in a range of 100 Hz to 5000 Hz, preferably, 500 Hz to 2000 Hz. If the frequency is below the aforementioned range, the adhesion of magnetic particles to the drum is worse, and also the effect of the AC component is weak in terms of improvement in charge uniformity and the speed at which the potential level of an object to be charged rises. If the frequency is above the aforementioned range, it is difficult for the AC component to be effective in terms of improvement in charge uniformity and the speed at which the potential level of the object to be charged rises. The wave form of the AC component is desired to be a rectangular wave form, a triangular wave form, a sine wave form, or the like.

As for the magnetic particles 2*d* which form the magnetic brush 2*c* in this embodiment, material obtained by reducing sintered ferromagnetic material (ferrite) is used. However, other materials may be used in the same manner. For example, resin material and ferromagnetic material may be kneaded and then pulverized into particles. Further, electrically conductive carbon particles or the like may be mixed into the thus obtained magnetic particles to adjust the electrical resistance value thereof, and also surface treatment may be given to the thus obtained magnetic particles.

Not only must the magnetic particles of the magnetic brush 2*c* be able to desirably inject charge into the traps in the surface layer of the drum as the object to be charged, but also must be able to prevent the charging member and the drum from being damaged by the electric current which concentrates to the defects such as pin holes in the drum.

Therefore, it is desirable that the resistance value of the magnetic brush type charging member 2A is in the range of $1\times10^4$–$1\times10^9$ ohm, preferably, $1\times10^4$–$1\times10^7$ ohm. If it is no more than $1\times10^4$ ohm, pin hole leakage is liable to occur, and if it exceeds $1\times10^9$ ohm, charge is not likely to be desirably injected. Further, in order to keep the resistance value within the aforementioned range, the volumetric resistivity of the magnetic particles 2*d* is desired to be in a range of $1\times10^4$–$1\times10^9$ ohm.cm, preferably, $1\times10^4$–$1\times10^7$ ohm.cm.

Figure 4:
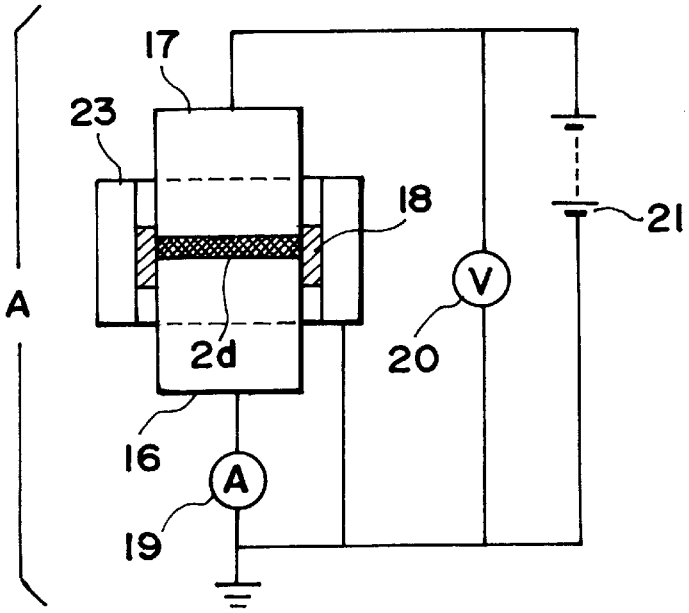
FIG. 4 is a diagram which shows a method for measuring the volumetric resistivity value of magnetic particles.
Figure 5:
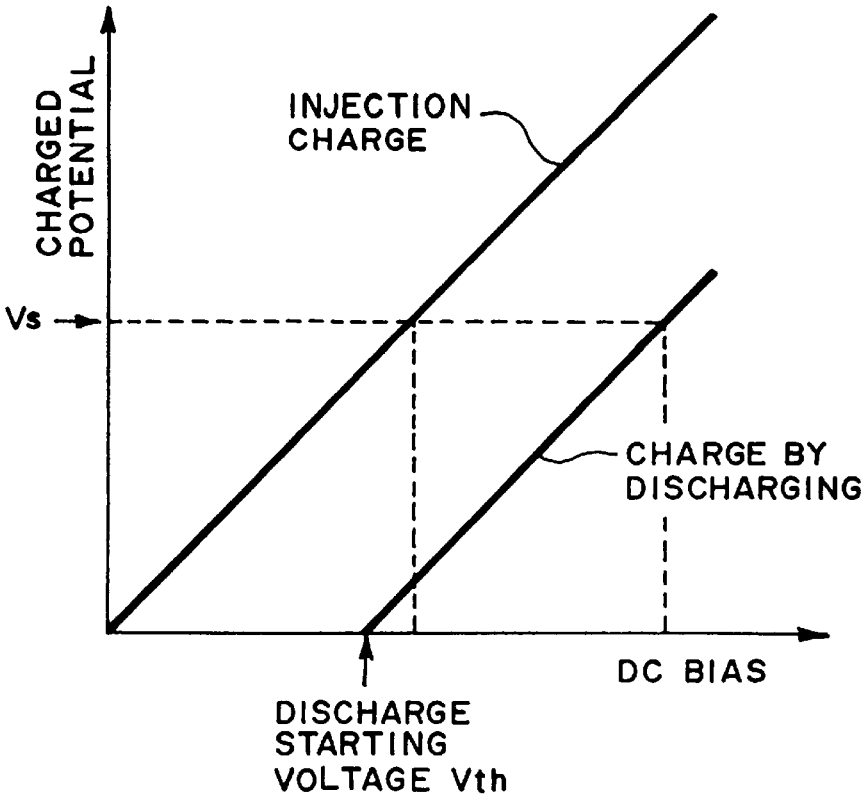
FIG. 5 is a graph which shows the relationship between the bias applied and the level of the obtained potential, when an object is charged using a charge injection system, and the relationship between the bias applied and the level of the obtained potential, when an object is charged using an electrical discharge based system.
Figure 6:
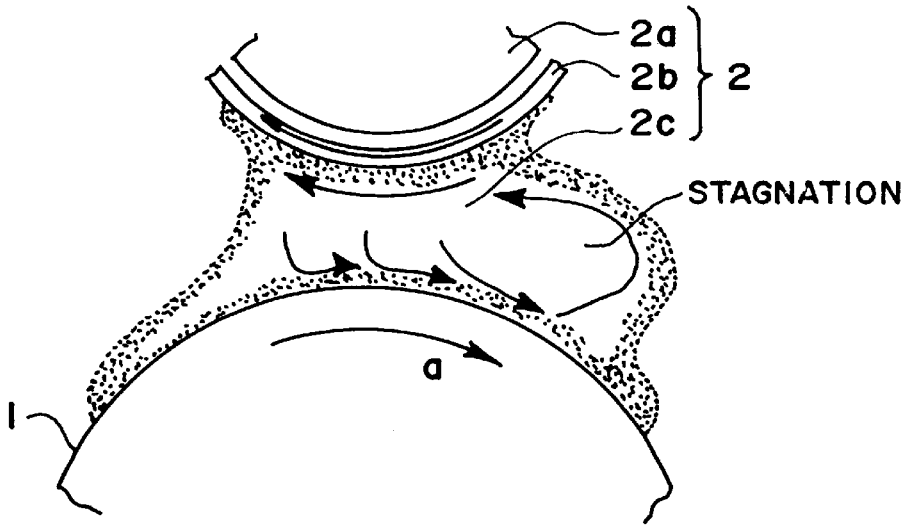
FIG. 6 is a schematic section of a charging nip portion, depicting the behavior of magnetic particles.
Figure 7:
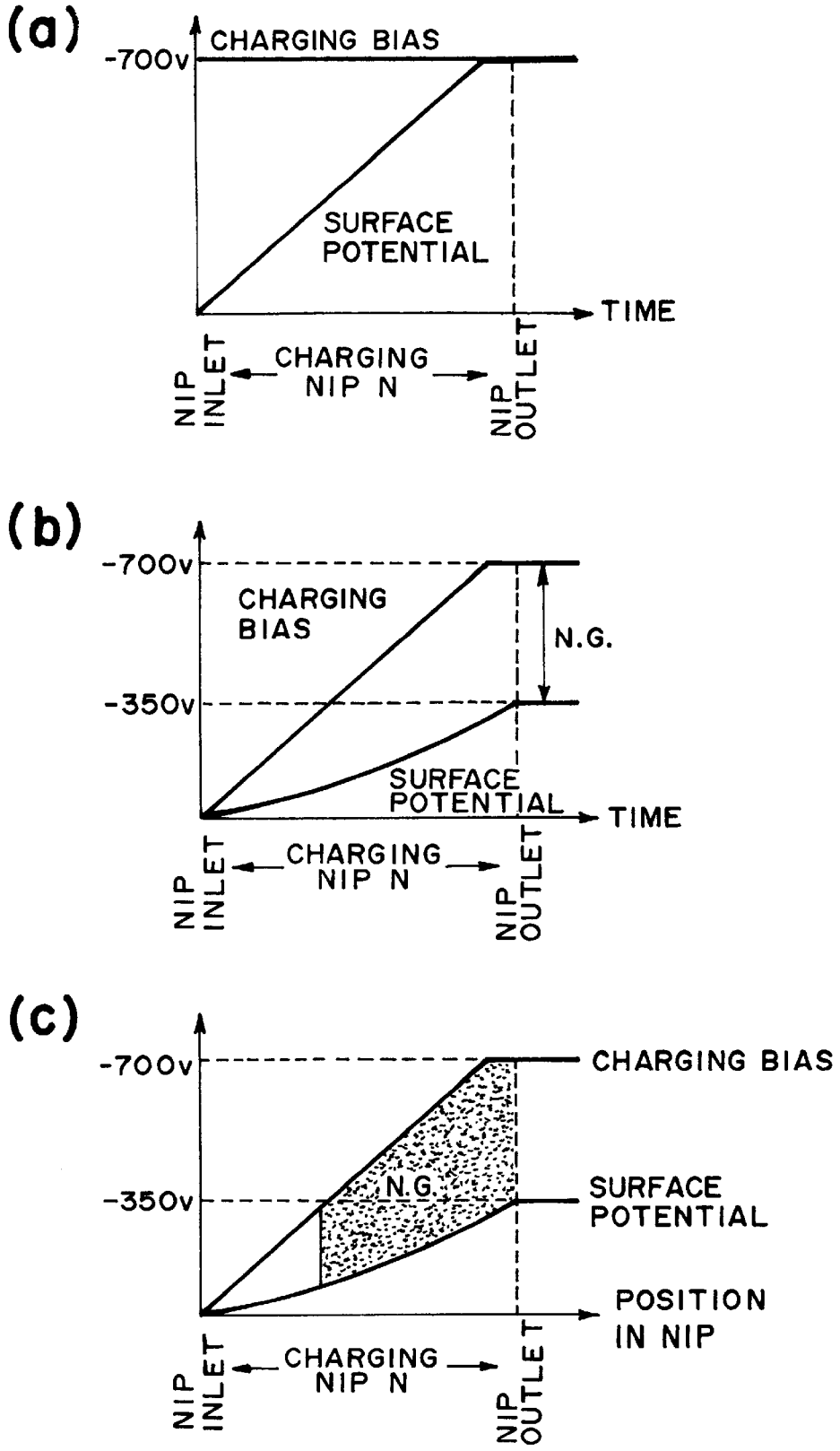
FIGS. 7, (*a*), (*b*) and (*c*) are graphs which show the relationship among the level of charge bias applied to any given spot on the surface of an object to be charged, the level of the potential obtained by the spot, the elapsed time from the beginning of the charge bias application, and the position of the spot at the beginning of charge bias application.

The value of the volumetric resistivity of the magnetic particles 2*d* is measured using the method illustrated in FIG. 4. That is, the magnetic particles 2*d* are packed in a cell A, and a main electrode 16 and a top electrode 17 are disposed in contact with the packed magnetic particles 2*d*. Then, the current which flows through the packed magnetic particles 2*d* while the voltage from a constant voltage power source 21 is applied between the electrodes 16 and 17 is measured by an ammeter 19. A reference numeral 18 designates an electrically insulative member; 20, a voltmeter; and a reference numeral 23 designates a guide ring.

As for the other factors pertaining to the measurement, the temperature and humidity were 23° C. and 65%, respectively; the size S of the contact area between the packed magnetic particles 2*d* and the cell, 2 $cm^2$; thickness d, 1 mm; the load applied to the top electrode 17, 10 kg; and the applied voltage was 100 V.

From the standpoint of preventing charge from being deteriorated by the contamination of the particle surface, the average particle diameter of the magnetic particles 2*d* is desired to be such that the peak of the measured particle size distribution is in a range of 5–100 μm.

The average particle diameter of the magnetic particles 2*d* is expressed in maximum chord length. As for the method for obtaining it, no less than 300 magnetic particles are randomly selected; their diameters are actually measured using a microscope; and the thus obtained values are arithmetically averaged to give the average diameter of the magnetic particles 2*d*.

Embodiment 1

The resistance value of the magnetic brush type charging member 2A in this embodiment was $1\times10^6$ ohm.cm. When a voltage of −700 V was applied as the DC component of the charge bias, the surface potential level of the drum 1 reached −700 V. In this embodiment, a DC power source was employed instead of the power source 2C illustrated in FIG. 3.

With the provision of the above structure, the total amount of the magnetic particles which are separated from the magnetic brush type charging member 2A and adhered to the peripheral surface of the drum 1 was measured while the drum 1 was charged under various conditions, that is, charging the order in which the drum rotation, the sleeve rotation, and the charge bias (DC component) application are stopped. The amount of the magnetic particles which were adhering to the drum surface in the nip after the drum 1 was charged was measured by slightly rotating the drum 1 after the drum 1 was charged. The interval between the points of time at which the drum rotation, the sleeve rotation, or the charge bias application was stopped was 100 msec. The results are shown in Table 1.

TABLE 1

| Stop charging | D-S-B | D-B-S | B-D-S | B-S-D | S-B-D | S-D-B |
|---|---|---|---|---|---|---|
| Nip | 0.14 g | 0.00 g | 0.00 g | 0.00 g | 0.00 g | 0.14 g |
| Down-stream of nip | 0.00 g | 0.00 g | 0.12 g | 0.12 g | 0.15 g | 0.00 g |

D: Drum rotation stop
S: Sleeve rotation stop
B: Bias stop

Figure 8:
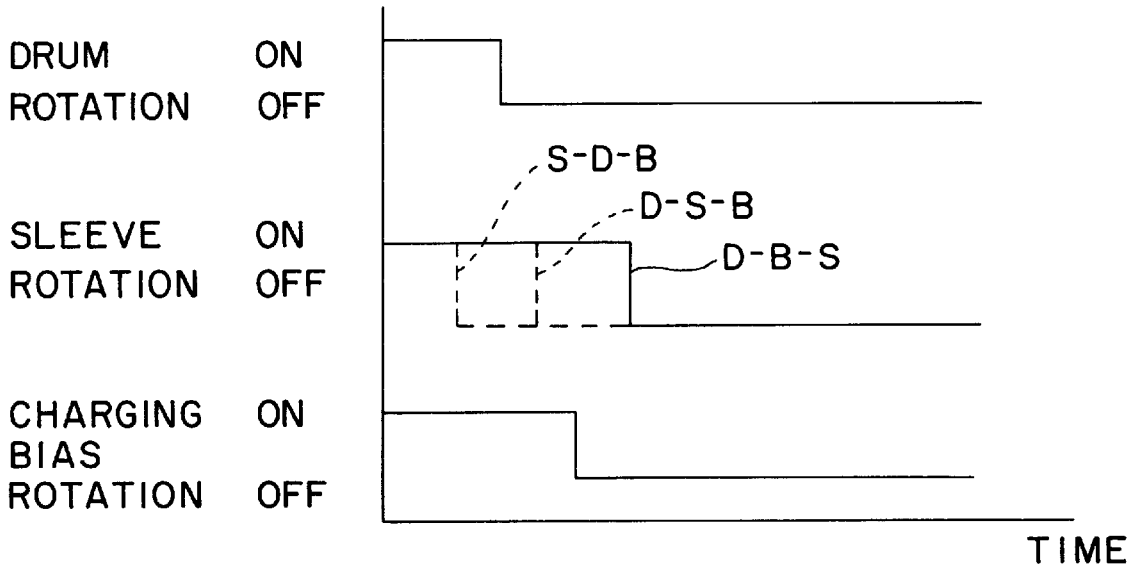
FIG. 8 is a timing chart depicting the on and off timings of the photosensitive drum, sleeve and bias.

It is evident from the table that in order to prevent the magnetic particles from adhering to the peripheral surface of the drum 1, on the areas other than the area in the charging nip, it is necessary to stop the rotation of the drum 1 before the charge bias application is stopped. FIG. 8 is a timing chart depicting the order of on/off timings according to the preferred embodiments.

When the order of stopping is D-S-B (drum 1→sleeve 2*b*→bias), and S-D-B (sleeve 2*b*→drum 1→bias), a small amount of magnetic particles remains in contact with the drum surface, on the area in the charging nip N, and therefore, it is possible for these magnetic particles to become separated from the magnetic brush portion at the beginning of the drum rotation.

When the order of stopping is D-B-S (drum 1→bias→sleeve 2*b*), the magnetic particles which are adhering to the drum surface, on the area in the charging nip, when the bias is stopped, are recovered by the rotation of the sleeve 2*b*. This order of stopping is most desirable.

Embodiment 2

The amount of the magnetic particles which were separated from the magnetic brush type charging member 2A and were adhered to the peripheral surface of the drum 1 was measured, changing the order in which the drum rotation, the sleeve rotation, and the charge bias (DC component) application were started at the beginning of a charging process in which the same DC component as that in the first embodiment was applied to the sleeve 2*b*. It should be not here that the tests were conducted under the condition that no magnetic particle was adhering to the drum surface, on the area in the nip, at the beginning of the charging process. The results are shown in Table 2.

TABLE 2

| Start charging | D-S-B | D-B-S | B-D-S | B-S-D | S-B-D | S-D-B |
|---|---|---|---|---|---|---|
| Deposition | 0.12 g | 0.14 g | 0.13 g | 0.00 g | 0.00 g | 0.12 g |

TABLE 2-continued

D: Drum rotation start
S: Sleeve rotation start
B: Bias stop

Figure 9:
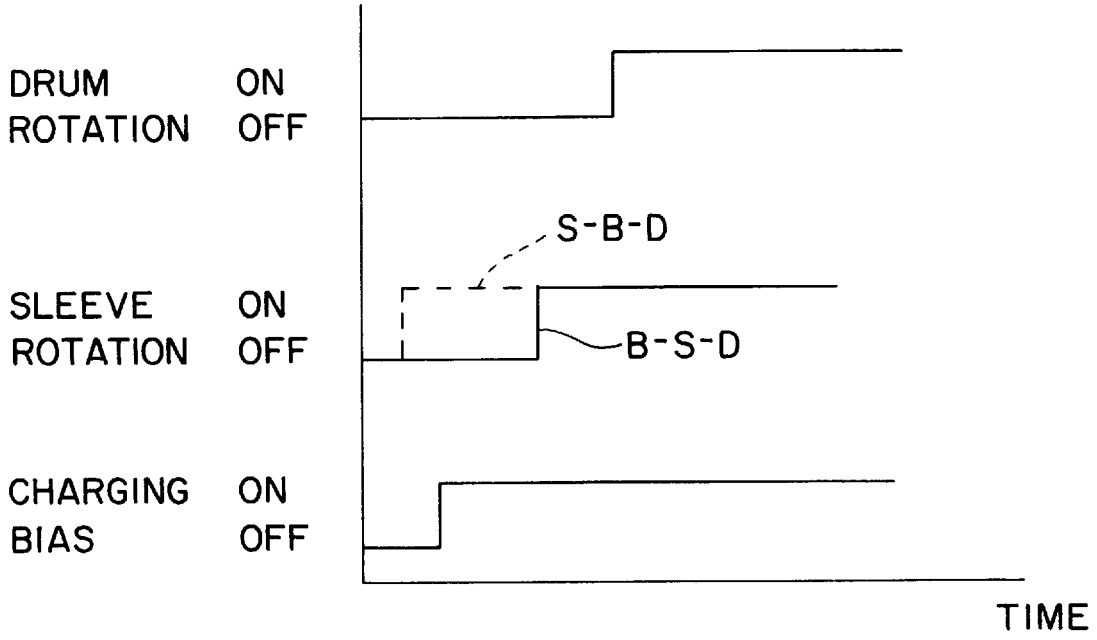
FIG. 9 is a timing chart depicting the on and off timings of the photosensitive drum, sleeve and bias.

Among the six starting timing patterns in Table 2, the B-S-S (bias→sleeve 2*b*→drum 1) pattern, and the S-B-D (sleeve 2*b*→bias→drum 1) pattern have the least amount of magnetic particle adhesion, indicating that the drum rotation is desired to be started after the bias application or the sleeve rotation is started. FIG. 9 is a timing chart depicting the order of the start timing patterns according to the preferred embodiments.

Embodiment 3

This embodiment is similar to the first embodiment, except for the type of charge bias; in this embodiment, charge bias composed of a DC component and an AC component (Vpp=700 V; f=1 kHz; wave form: rectangular) superimposed on the DC component was used in place of the DC bias used in the first embodiment. The amount of the magnetic particle adhesion was investigated also in the same manner as in the first embodiment.

In the first embodiment, the magnetic particle adhesion to the drum surface, except for the adhesion to the area in the charging nip at the time when each charging process is completed, could be prevented by stopping the drum rotation first; therefore, the drum rotation was stopped first also in this embodiment. More specifically, the amount of the magnetic particle adhesion was measured while changing the order in which the AC application, the DC application, and the sleeve rotation are stopped after the drum rotation is stopped first, and the order in which the AC application and the DC application were stopped at the same time after the drum rotation was stopped first.

When the stopping timing was in the order of the drum rotation→the AC application and the DC application (stopped at the same time)→the sleeve rotation, a small amount of the magnetic particle adhesion could be observed on the area adjacent to the downstream side of the charging nip portion relative to the direction of the drum rotation. This is due to the following phenomenon. That is, the magnetic particle adhesion occurs in the charging nip portion widened by the magnetic particle aggregation caused by the AC application, but such magnetic particle application stops as the AC application is stopped.

The amount of the magnetic particle adhesion which occurred when the AC application and the DC application was separately stopped is given in Table 3.

TABLE 3

| Stop charging | AC-DC-S | AC-S-DC | DC-AC-S | DC-S-AC | S-AC-DC | S-DC-AC |
|---|---|---|---|---|---|---|
| Nip | 0.00 g | 0.14 g | 0.00 g | 0.00 g | 0.16 g | 0.16 g |

S: Sleeve rotation stop
DC: DC bias stop
AC: AC bias stop

Figure 10:
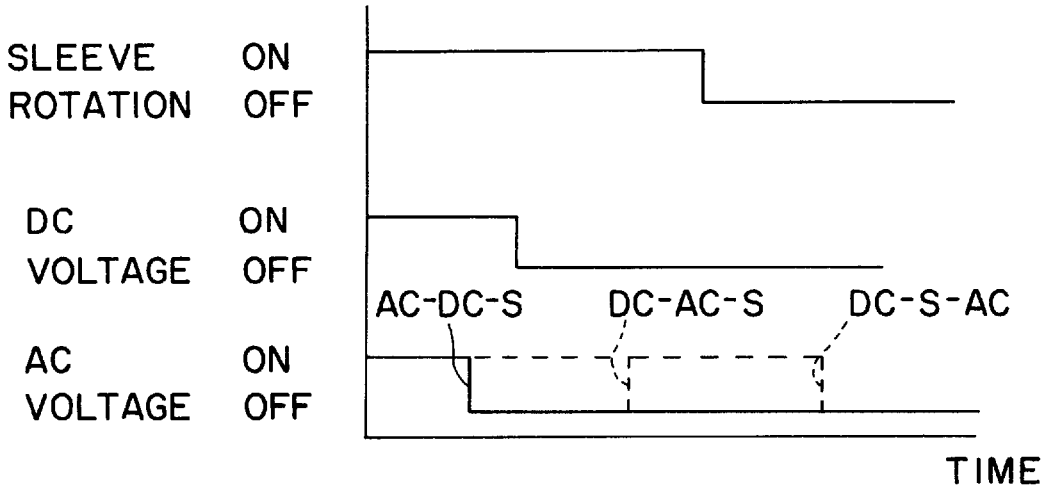
FIG. 10 is a timing chart depicting the supply of the AC component and DC component to the photosensitive drum in relation to sleeve rotation.

It is evident from the results given in Table 3 that in order to prevent the magnetic particle adhesion, the DC application has only to be stopped before the sleeve rotation is stopped, and also that the amount of the magnetic particle adhesion is not dependent upon the order in which the AC application is stopped. FIG. 10 is a timing chart depicting the order of the stop timing patterns according to the preferred embodiments.

Further, also in this embodiment, the AC application is stopped first at the end of each charging process, which is the same as in the first embodiment. It is evident that the magnetic particle adhesion does not occur when the stopping order is "AC application→drum rotation→DC application→sleeve rotation".

Embodiment 4

This embodiment is similar to the second embodiment, except for the type of charge bias; in this embodiment, a charge bias composed of a DC component and an AC component (Vpp=700 V; f=1 kHz; wave form: rectangular) superimposed on the DC component was used in place of the DC bias used in the first embodiment. The amount of the magnetic particle adhesion was investigated also in the same manner as in the first embodiment.

In the second embodiment, the magnetic particle adhesion did not occur when the drum rotation was started last. Therefore, the drum rotation was started last also in this embodiment. The amount of the magnetic particle adhesion was measured while changing the order in which the AC application, the DC application, and the sleeve rotation were started. As a result, the magnetic particle adhesion could not be observed in any of the starting order combinations, indicating that the magnetic particle adhesion can be prevented by starting the drum rotation last.

Miscellaneous Embodiments (1) Not only can a magnetic brush type charging apparatus in accordance with the present invention be employed as the means for charging the image bearing member of an image forming apparatus as it was in the preceding embodiments, but also can be employed as an effective contact type charging means for charging a wide range of objects to be charged.

(2) An object (image bearing member) to be charged may be dominantly charged through electrical discharge.

(3) Choice of the magnetic brush type charging member is not limited to the rotary sleeve type member described in the preceding embodiments. For example, it is possible to employ one of charging members of the following magnetic brush types: a type in which the magnetic roller 2*a* itself is rotated in place of the sleeve 2*b*; a type in which the surface of the magnetic roller 2*a* is rendered electrically conductive through an appropriate treatment, is given a resistive layer, and is rotated as a power supply terminal; or a type in which a magnetic brush is nonrotative.

(4) Choice of exposing means as information writing means which exposes the charged surface of an image bearing member with an optical image is not limited to the exposing means of a scanning laser beam type which forms a digital latent image as described in the preceding embodiments. Any exposing means is employable as long as it is capable of forming an electrostatic latent image accurately reflecting image information; for example, an analogue type exposing means whose light source is a halogen lamp, a fluorescent light, a light emitting elements such as an array of LEDs, a combination of light emitting elements such as fluorescent lights and a light crystal shutter, or the like exposing means, may be employed.

(5) An image bearing member may be an electrostatically recordable dielectric member or the like. In the case of an electrostatically recordable dielectric member, the surface of the dielectric member is uniformly charged first, and then, the surfaced surface is selectively discharged, at various points correspondent to the image information of a target image, by a discharging means such as a needle type discharging head or an electron gun, to write an electrostatic latent image corresponding to the image information of a target image, on the surface of the dielectric member.

As for an image forming process, it is optional. It may be of a transfer type, or a direct type. In the case of the later, no image transfer process is involved, and an image is directly formed on photosensitive paper (electro-fax sheet) or electrostatic recording paper.

(6) Choice of the toner based developing means is also optional. It may be of a reverse development type or a normal development type.

(7) Choice of the transferring means is not limited to the corona discharge type transferring means. A transferring means of a roller type or a blade type may be optionally employed.

Not only is the present invention applicable to a monochrome image forming apparatus, but also it is applicable to an image forming apparatus which employs an intermediary transfer member, such as a transfer drum or a transfer belt, to form multi-color images or full-color images, as well as monochrome image, through a multi-layer transfer process or the like.

(8) Choice of the image forming process for an image forming apparatus does not need to be limited to the process described in the preceding embodiments; it is optional, and additional processing devices may be employed when necessary.

It is optional to integrate the image bearing member 1, the magnetic brush type charging apparatus 2, the developing apparatus 4, the cleaner 6, and the like, into a process cartridge which is removable installable in the main assembly of an image forming apparatus. Such a process cartridge has only to comprise the image bearing member 1, and at least one processing apparatus among the charging apparatus 2, the developing apparatus 4, and the cleaner 6.

(9) An image forming apparatus in accordance with the present invention includes an image displaying apparatus, which comprises an image bearing member in the form of an electrophotographically sensitive rotary belt or an electrostatically recordable dielectric rotary belt, and an image displaying portion, wherein toner images are formed on the rotary belt type image bearing member through a charging process, an electrostatic latent image forming process, and a developing process, and the toner image forming portion is positioned in the image displaying portion to display the toner images. Also in this type of image forming apparatus, the image bearing member is repeatedly used to form the images to be displayed.

(10) The present invention is also applicable to an image bearing member of a cleaner-less type, that is, a type in which the cleaner 6 is eliminated, and the toner remaining on the drum 1 after the toner image transfer to the recording material P is removed and recovered by the developing apparatus 4 at the same time as a latent image is developed by the developing apparatus 4.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a charging member for being supplied with a voltage to electrically charge a rotatable member to be charged, said charging member including an electroconductive particle layer contactable to the member to be charged, and a rotatable carrying member for carrying said electroconductive particle layer;

wherein said member to be charged starts to rotate after start of the rotation of said carrying member.

2. A device according to claim 1, wherein the member to be charged starts to rotate after start of application of the voltage.

3. A device according to claim 1, wherein the voltage contains a DC component, and application of the DC component is stopped after stop of the rotation of the member to be charged.

4. A device according to claim 3, wherein said carrying member is rotatable, and rotation of said carrying member is stopped after stop of application of the DC component.

5. A device according to claim 1, wherein the voltage contains a DC component and an AC component.

6. A device according to claim 2, wherein the voltage contains a DC component and an AC component.

7. A device according to claim 3, wherein the voltage further contains an AC component, and stop timing of the application of the DC component is different from stop timing of application of the AC component.

8. A device according to claim 4, wherein the voltage further contains an AC component, and stop timing of the application of the DC component is different from stop timing of application of the AC component.

9. A device according to claim 1, wherein said carrying member is rotatable, and directions of movement of the member to be charged and said carrying member are different from each other at a position where the member to be charged and said magnetic particle layer are contacted.

10. A device according to claim 1, wherein the electroconductive particles are magnetic, and said carrying member includes a rotatable non-magnetic member, and said apparatus further comprises a magnet roller in said carrying member.

11. A charging device comprising:

a charging member for being supplied with a voltage containing a DC component to electrically charge a rotatable member to be charged, said charging member including a electroconductive particle layer contactable to the member to be charged and a carrying member for carrying said electroconductive particle layer;

wherein application of the DC component is stopped after stop of rotation of the member to be charged.

12. A device according to claim 11, wherein said carrying member is rotatable, and rotation of said carrying member stops after stop of application of the DC component.

13. A device according to claim 11, wherein the voltage further contains an AC component, and stop timing of the application of the DC component is different from stop timing of application of the AC component.

14. A device according to claim 12, wherein the voltage further contains an AC component, and stop timing of the application of the DC component is different from stop timing of application of the AC component.

15. A device according to claim 11, wherein said carrying member is rotatable, and directions of movement of the member to be charged and said carrying member are different from each other at a position where the member to be charged and said magnetic particle layer are contacted.

16. A device according to claim 11, wherein the electroconductive particles are magnetic, and said carrying member includes a rotatable non-magnetic member, and said apparatus further comprises a magnet roller in said carrying member.

17. An image forming apparatus comprising:

a rotatable member to be charged including a surface layer having a volume resistivity of $1\times10^{10}$–$1\times10^{14}$ Ωcm, said member to be charged being capable of carrying an image;

image forming means for forming an image in said member to be charged, said image forming means including a charging member for being supplied with a voltage to electrically charge said member to be charged, said charging member including an electroconductive particle layer contactable to the member to be charged and a rotatable carrying member for carrying an electroconductive particle layer;

wherein the member to be charged starts to rotate after start of the rotation of said carrying member.

18. An apparatus according to claim 17, wherein the member to be charged starts to rotate after start of application of the voltage.

19. An apparatus according to claim 17, wherein the voltage contains a DC component, and application of the DC component is stopped after stop of the rotation of the member to be charged.

20. An apparatus according to claim 19, wherein said carrying member is rotatable, and rotation of said carrying member is stopped after stop of application of the DC component.

21. An apparatus according to claim 17, wherein the voltage contains a DC component and an AC component.

22. An apparatus according to claim 18, wherein the voltage contains a DC component and an AC component.

23. An apparatus according to claim 19, wherein the voltage further contains an AC component, and stop timing of the application of the DC component is different from stop timing of application of the AC component.

24. An apparatus according to claim 20, wherein the voltage further contains an AC component, and stop timing of the application of the DC component is different from stop timing of application of the AC component.

25. An apparatus according to claim 17, wherein said carrying member is rotatable, and directions of movement of the member to be charged and said carrying member are different from each other at a position where the member to be charged and said magnetic particle layer are contacted.

26. An apparatus according to claim 17, wherein said carrying member includes a rotatable non-magnetic member, and said apparatus further comprises a non-rotatable magnet roller in said carrying member.

27. An apparatus according to claim 17, wherein said surface layer comprises insulative binder and electroconductive particles dispersed therein.

28. An apparatus according to claim 17 or 27, wherein the member to be charged has an electrophotographic photosensitive layer inside said surface layer.

29. An image forming apparatus comprising:

a rotatable member to be charged including a surface layer having a volume resistivity of $1\times10^{10}$–$1\times10^{14}$ Ωcm, said member to be charged being capable of carrying an image;

image forming means for forming an image in said member to be charged, said image forming means including a charging member for being supplied with a voltage containing a DC component to electrically charge said member to be charged, said charging member including a electroconductive particle layer contactable to the member to be charged and a carrying member for carrying a electroconductive particle layer;

application of the DC component is stopped after stop of the rotation of the member to be charged.

30. An apparatus according to claim 29, wherein said carrying member is rotatable, and rotation of said carrying member stops after stop of application of the DC component.

31. An apparatus according to claim 29, wherein the voltage further contains an AC component, and stop timing of the application of the DC component is different from stop timing of application of the AC component.

32. An apparatus according to claim 30, wherein the voltage further contains an AC component, and stop timing of the application of the DC component is different from stop timing of application of the AC component.

33. An apparatus according to claim 29, wherein said carrying member is rotatable, and directions of movement of the member to be charged and said carrying member are different from each other at a position where the member to be charged and said magnetic particle layer are contacted.

34. An apparatus according to claim 29, wherein the electroconductive particles are magnetic, and said carrying member includes a rotatable non-magnetic member, and said apparatus further comprises a magnet roller in said carrying member.

35. An apparatus according to claim 29, wherein said surface layer comprises insulative binder and electroconductive particles dispersed therein.

36. An apparatus according to claim 29 or 35, wherein the member to be charged has an electrophotographic photosensitive layer inside said surface layer.

* * * * *

UNITED STATES PATENT AND TRADEMARK OFFICE

CERTIFICATE OF CORRECTION

PATENT NO. : 6,125,246

DATED : September 26, 2000

INVENTOR(S) : Kouichi Hashimoto

It is certified that error appears in the above-identified patent and that said Letters Patent is hereby corrected as shown below:

COLUMN 2

Line 34, "terminal In" should read --terminal. In--; and
Line 41, "bristles or" should read --bristles of--.

COLUMN 3

Line 35, "instants" should read --instance--; and
Line 37, "instants" should read --instance--.

COLUMN 4

Line 67, "maximum) certain" should read --maximum), a certain--.

COLUMN 7

Line 59, "if" should read --If--; and
Line 66, "Hewlette" should read --Hewlett--.

COLUMN 9

Line 25, "an the" should read --and the--.

COLUMN 13

Line 58, "elements" should read --element--.

UNITED STATES PATENT AND TRADEMARK OFFICE

CERTIFICATE OF CORRECTION

PATENT NO. : 6,125,246

DATED : September 26, 2000

INVENTOR(S) : Kouichi Hashimoto

It is certified that error appears in the above-identified patent and that said Letters Patent is hereby corrected as shown below:

COLUMN 14

Line 7, "later" should read --latter--.

COLUMN 15

Line 42, "a electroconductive" should read --an electroconductive--.

COLUMN 16

Line 65, "a electroconductive" should read --an electroconductive--; and

Line 67, "a electroconductive" should read --an electroconductive--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*